United States Patent [19]

Kok et al.

[11] Patent Number: 5,013,628

[45] Date of Patent: May 7, 1991

[54] PARTICULATE TONER MATERIAL WITH CHARGE CONTROL AGENT

[75] Inventors: Piet Kok, Ghent; Luc J. Vanmaele, Lochristi; Serge M. Tavernier, Lint; Hedwig E. De Deyne, Rumst, all of Belgium

[73] Assignee: AGFA-Gevaert, N.V., Mortsel, Belgium

[21] Appl. No.: 475,202

[22] Filed: Feb. 5, 1990

[30] Foreign Application Priority Data

Feb. 8, 1989 [EP] European Pat. Off. ..... 89200290.8

[51] Int. Cl.[5] ..... G03G 9/097

[52] U.S. Cl. ..... 430/110; 546/191

[58] Field of Search ..... 430/110

[56] References Cited

FOREIGN PATENT DOCUMENTS 84693 8/1983 European Pat. Off. ..... 430/110

177568 10/1984 Japan ..... 430/110

188959 9/1985 Japan ..... 430/110

3149 1/1986 Japan ..... 430/110

143769 7/1986 Japan ..... 430/110

266462 11/1988 Japan ..... 430/110

*Primary Examiner*—Roland Martin

*Attorney, Agent, or Firm*—William J. Daniel

[57] ABSTRACT

Particulate toner material for use in the development of latent electrostatic images, wherein said particulate toner material is capable of acquiring by triboelectric contact electrification when in admixture with carrier particles a net positive charge and contains at least one thermoplastic resin as binder in combination with a colorant and a colorless compound capable of imparting a positive charge to the particulate toner material when in frictional contact with said carrier particles, characterized in that said colorless compound contains in it molecular structure at least one polyalkyl substituted piperidine group and a sterically hindered phenol group.

11 Claims, No Drawings

PARTICULATE TONER MATERIAL WITH CHARGE CONTROL AGENT

DESCRIPTION

The present invention relates to particulate toner material for developing electrostatic charge patterns or images.

In electrostatography a latent electrostatic charge image is made visible, i.e. developed, by charged toner particles.

In electrophotography an electrostatic latent charge image is obtained with an electrophotographic material typically comprising a coating of a photoconductive insulating material on a conductive support. Said coating is given a uniform surface charge in the dark and is then exposed to an image pattern of activating electromagnetic radiation such as light or X-rays. The charge on the photoconductive element is dissipated in the irradiated area to form an electrostatic charge pattern which is then developed with an electroscopic marking material. The marking material or toner, as it is also called, whether carried in an insulating liquid or in the form of a dry powder deposits on the exposed surface in accordance with either the charge pattern or the discharge pattern as desired. If the photoconductive element is of the reusable type, e.g. a selenium coated drum, the toner image is transferred to another surface such as paper and then fixed to provide a copy of the original.

A variety of electrostatic developers are available for use in developing electrostatic charge patterns. A distinction is made between dry and liquid developers. According to a known embodiment in dry developers carrier particles are mixed with toner particles electrostatically adhering thereto. The carrier may comprise various materials and as the name implies, serves as a medium for carrying the electrostatically responsive marking particles to the charge pattern to be developed. Among the more common types of carrier-toner developers are dry developers known for use in cascade development as described e.g. in U.S. Pat. No. 2,618,552 and for use in magnetic brush development as described e.g. in U.S. Pat. No. 3,003,462.

The cascade development technique is carried out by rolling or cascading across the electrostatic latent image bearing surface, a developing mixture composed of relatively large carrier particles, each having a number of electrostatically adhering toner particles on its surface. As this mixture rolls across the image-bearing surface, the toner particles are electrostatically deposited on the charged portions of the image.

The magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a means with magnetic poles mounted inside. The magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. When this brushlike mass of magnetic carrier particles with adhering toner particles is drawn across the surface bearing the electrostatic image, the toner particles are electrostatically attracted to an oppositely charged latent image and form a visible toner image corresponding to the electrostatic image. Since electrostatic charge remains in the non-exposed areas of a photoconductive surface, electrophotography is inherently a direct positive process. In some instances, however, photocopying requires the production of positive prints from photographic negatives.

Such is possible when the original is a negative due to the fringe effect. By the fringe effect negative charges will be induced in the exposed areas which carried originally positive charges that leaked off by the photoexposure. So, if a photoconductor coating being originally overall charged positively has lost its positive charge in correspondence with the line pattern of the original negative, charges of negative sign will be induced in the exposed line pattern by the fringe effect of the still surrounding positive charge pattern. As a consequence positively charged toner will become attracted by said negative charges and a positive image will be developed with respect to the original negative.

Reversal development of large image area will likewise be possible by applying a bias voltage to a magnetic brush applicator which acting as a development electrode induces when positively charged, through the conductive carrier particles a negative charge in the discharged area of the previously positively charged photoconductor coating (ref. R. M. Schaffert "Electrophotography" The Focal Press-London, New York enlarged and revised edition 1975 p. 50–51 and T. P. Maclean "Electronic Imaging" Academic Press-London, 1979 p. 231).

In dry toner development systems the toner is normally a fine powder of natural or synthetic resins having a colorant and a charge controlling agent dissolved or dispersed therein.

Known positive charge controlling compounds for use in dry toners are dye bases and salts thereof such as nigrosine dye base and salts described in GB-P 1,253,573. Such charge controlling agents are usually added to the thermoplastic resin to be dispersed in the resin in molten state. Upon cooling the mixture is micropulverized and the particles with desired particle size separated e.g. by wind sifter.

Coloured charge controlling substances have the disadvantage that their colour interferes with the colour intentionally given to the toner mass. For the obtaining of neutral black or spectrally pure colours required in multicolour reproduction the inherent colour of the charge controlling substance may form a serious obstacle. Therefore preference is given to the use of colourless charge controlling substances.

According to the published unexamined Japanese patent application (Kokai) 6 0188-959 an electrostatic image developing toner contains as charge controlling agent a piperidine compound corresponding to the following general formula (I):

(I)

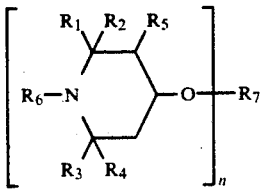

wherein: $R_1$, $R_2$, $R_3$ and $R_4$ are each 1-6C alkyl, $R_5$ is hydrogen or 1-5C alkyl, $R_6$ is hydrogen or 1-12C alkyl or 3-12C alkenyl, or 7-12C aralkyl; n is an integer of 1-4 and $R_7$ is acyl or N-substituted carbamoyl where n is 1, diacyl, dicarbamoyl or carbonyl where n is 2, triacyl where n is 3 and tetraacyl where n is 4.

It is an object of the present invention to provide a particulate toner material for developing electrostatic charge images which toner material contains a colourless transparent charge controlling agent that does not interfere with the colouring agent of the toner material and also acts as stabilizing agent protecting organic dyes against discolouration by the action of light, ultraviolet radiation and the heat applied in thermal fixing of the toner image.

It is a further object of the present invention to provide such toner material wherein the charge controlling agent yields a particularly high positive charge to the toner particles and has a good miscibility or compatibility with the polymeric binder material present in the toner material.

Other objects and advantages of the present invention will become clear from the further description.

In accordance with the present invention there is provided particulate toner material for use in the development of latent electrostatic images, wherein said particulate toner material is capable of acquiring by triboelectric contact electrification when in admixture with carrier particles a net positive charge and contains at least one thermoplastic resin as binder in combination with a colorant and a colourless compound capable of imparting a positive charge to the particulate toner material when in frictional contact with said carrier particles, characterized in that said colourless compound contains in its molecular structure at least one polyalkyl substituted piperidine group and a sterically hindered phenol group.

In the particulate toner material according to the present invention said colourless compound is used preferably in an amount in the range of 0.5 to 5% by weight with respect to the total toner composition.

Preferred compounds for use according to the present invention correspond to the following general formula (A):

(A)

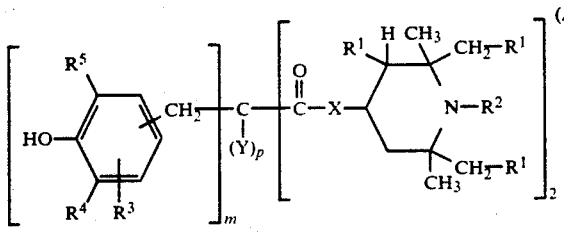

wherein:

$R^1$ is hydrogen or alkyl having 1 to 4 carbon atoms, $R^2$ is alkyl or hydroxyalkyl, each having 1 to 12 carbon atoms, alkenyl or alkynyl each having 3 to 4 carbon atoms or aralkyl such as benzyl, $R^3$ is hydrogen or methyl, $R^4$ and $R^5$ are each alkyl having 1 to 5 carbon atoms or cycloalkyl having 5 to 8 carbon atoms, X is oxygen or NH, Y is hydrogen, alkyl having 1 to 12 carbon atoms or $-C_nH_nCOOR^7$, in which n is 0 or an integer from 1 to 10 and $R^7$ is hydrogen, alkyl having 1 to 18 carbon atoms, especially methyl or ethyl, or the Y is a substituent of the formula:

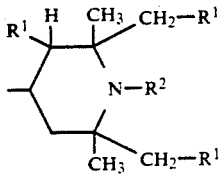

wherein:

$R^1$ and $R^2$ are as defined above, or

Y is a substituent of the formula:

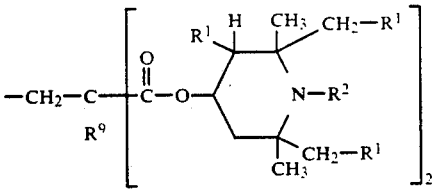

wherein:

$R^1$ and $R^2$ are as defined above, and $R^9$ is hydrogen or alkyl having 1 to 4 carbon atoms, especially methyl or ethyl, m is 1 or 2, and p is 0 or 1.

Typical representatives of compounds according to said general formula (A) wherein X is oxygen are described in U.S. Pat. No. 4,268,593 relating to recording material for colour photography wherein said compounds are used as light stabilizers.

The synthesis methods for preparing said compounds can be found in U.S. Pat. Nos. 4,198,334 and 4,268,593 and in German Offenlegungsschriften (DE-OS) Nos. 2,456,364, 2,647,452, 2,654,058 and 2,656,769.

For illustrative purposes the preparation of an ester compound according to the above general formula (A) having the following structural formula (Z) is given hereinafter.

(Z)

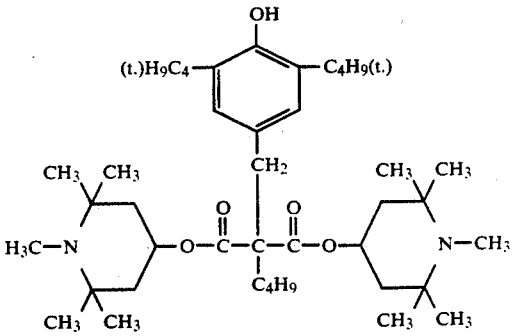

23.3 g of butylmalonic acid bis(1,2,2,2,6,6-pentamethyl-4-piperidinyl) ester and 13.2 g of N-(3,5-di-tert-butyl-4-hydroxybenzyl)dimethylamine were dissolved in 200 ml toluene. After addition of 0.25 g of $LiNH_2$, the mixture was refluxed for 15 minutes to give butyl(3,5-di-tert-butyl-4-hydroxybenzyl)malonic acid bis(1,2,2,6,6-pentamethyl-4-piperidinyl) ester. Melting point: 147° C.

Particularly high triboelectric positive charging of toner particles according to the present invention is obtained with the compound according to the above structural formula (Z).

The toner particle material according to the present invention may be used as so-called mono-component toner or in admixture with carrier particles.

The toner material can be prepared by any conventional technique such as spray drying a solution in a suitable volatile solvent or grinding a solidified composition of homogeneously mixed ingredients including a thermoplastic binder, colorant and at least one colourless positive charge-imparting polymeric amino compound according to said general formula (A).

The toner particles have preferably a particle size in the range of 3 to 30 μm, and more preferably in the range of 5 to 20 μm.

It has been established experimentally that when the basic ring nitrogen atom of the piperidine nucleus or nuclei according to the above general formula (A) is transformed into a salt form by reaction with an acid or by quaternization, the positive charge controlling properties are maintained.

Although the colourless charge controlling substances are preferably present in dissolved state in the thermoplastic resin binder of the toner, such is not strictly necessary. When said substances are present in dispersed state, the colour of the colorant is not as vivid because of the opalescent character of the dispersion. A "colloidal" dispersion is mostly obtained when amino-salts and quaternary derivatives of the compounds according general formula (A) are used.

When amino-salts or quaternary ammonium salts derived from the amines according to the above general formula (A) are used the anion(s) of these salts may be of any type known in the art. Suitable anions are e.g. hydroxyl ($OH^-$), chloride, iodide, sulfate, $ZnCl^{-4}$, and tolusulfonate. The affinity of the anion with respect to the carrier particle surface may play a role in the triboelectric charging [ref. the book "Electrophotography" by R. M. Schaffert, The Focal Press-London and New York (1975), p. 559-560].

For lowering the Coulomb attraction of the anions and cations, which may be in favour of the transfer of the anions of the toner particles to the carrier particles whereby triboelectric charging is improved, preferably anions of relatively large size are used, e.g. $PF_6^-$ and other large size anions such as the tetraphenylboride anion described for use in liquid electrophoretic developers in U.S. Pat. No. 4,525,446.

For obtaining a hard toner which is in favour of a longer developer lifetime by reducing "smearing" of the toner particles on the carrier particles, preference is given to thermoplastic resins having a melting point in the range of 100° to 120° C., a glass transition temperature (Tg) larger than 60° C., and in their structure a major part by weight of aromatic groups, e.g. phenyl groups. Said polymers may contain a minor part by weight of electron donating groups, e.g. alkylamino or arylamino groups to further improve the positive chargeability of the toner.

The charge imparting compounds applied according to the present invention yield particularly high positive charging when dissolved or dispersed in a thermoplastic binder being a resin selected from the group consisting of a homopolymer and copolymer of styrene wherein the styrene content is preferably at least 50 mole %. Preferred copolymers of styrene for use in toner material according to the present invention are copolymers of styrene-(meth)acrylic acid esters such as styrene-methyl acrylate copolymer, styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer, styrene-heptadecyl methacrylate copolymer, copoly(styrene-butadiene), and a copolymer of styrene including up to 25% by weight of monomer units comprising a dialkylamino group.

Preferred copolymers containing said group have the following structural formula (B):

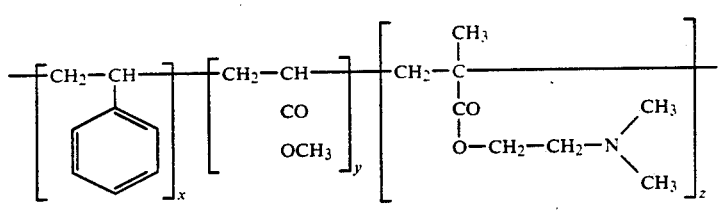

(B)

wherein:
x is 83-87% by weight
y is 0-4% by weight
z is 13-17% by weight,
and have a melting point (ring and ball method) in the range of 106° to 115° C.

Said copolymers which may be used separately or in combination can be prepared by common addition polymerisation starting with the monomers involved.

In the particulate toner material according to the present invention the colorant being a dye or pigment may be soluble or dispersable in the polymeric resin binder.

In order to obtain toner particles with sufficient optical density in the spectral absorption region of the colorant, the colorant is used preferably in an amount of at least 2% by weight with respect to the total toner composition, more preferably in an amount in the range of 5 to 15% by weight.

For black toners preference is given to carbon black as a colorant.

Examples of carbon black and analogous forms therefor are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.A.).

The characteristics of preferred carbon blacks are listed in the following table 1.

TABLE 1

| | SPEZIALSCHWARZ | CABOT REGAL 400 |
|---|---|---|
| origin | channel black | furnace black |
| density | 1.8 g × $cm^{-3}$ | 1.8 g × $cm^{-3}$ |
| grain size before entering the toner | 25 nm | 25 nm |
| oil number (g of linseed oil adsorbed by 100 g of pigment) | 300 | 70 |
| specific surface (sq. m per g) | 120 | 96 |
| volatile material (% by weight) | 12 | 2.5 |
| pH | 3 | 4.5 |
| colour | brown-black | black |

Toners for the production of colour images may contain organic dyes or pigments of various groups of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York (1950).

Typical inorganic pigments include black iron(III) oxide, copper(II) oxide and chromium(III) oxide powder, milori blue, ultramarine cobalt blue and barium permanganate.

In order to obtain toner particles having magnetic properties a magnetic or magnetizable material may be added during the toner production.

Magnetic materials suitable for said use are magnetic or magnetizable metals including iron, cobalt, nickel and various magnetizable oxides including (hematite) $Fe_2O_3$, (magnetite) $Fe_3O_4$, $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of any of these. Good results can be obtained with about 30% to about 80% by weight of magnetic material with respect to the resin binder of the toner.

In the preparation of the toner the colorant and optionally magnetic material may be added in finely divided state to the mixture of molten resin binder while stirring until a mixture of homogeneously dispersed or dissolved material in the resin melt is obtained. The mixing temperature is e.g. in the range of 100° to 150° C.

After cooling, the solid mass obtained is crushed and ground e.g. in a hammer mill followed by a jet-mill to an average particle size of 1 to 50 microns. The fraction having a particle size between 3-30 μm separated e.g. by air sifter is used. The resulting powder should not be tacky below 50° C.

For a given charge density of the charge-carrying surface the maximum development density attainable with toner particles of a given size is determined by the charge/toner particle mass ratio, which is determined substantially by the triboelectric charge obtained by friction-contact with the carrier particles.

In a particular embodiment the toner according to the present invention is applied in a carrier-toner mixture wherein the toner acquires a positive charge by frictional contact with the carrier. The carrier-toner mixture is preferably applied to the surface carrying a latent electrostatic image by cascade-, or magnetic brush development which techniques are described in detail by Thomas L. Thourson in his article "Xerographic Development Processes: A Review", IEEE Transactions on Electron Devices, Vol. ED-19, No. 4, April 1972 p. 497-504.

Suitable carrier particles for use in cascade and for magnetic brush development are described in GB-P 1,438,110.

The carrier particles are preferably at least 3 times larger in size than the toner particles. For use in cascade development their particle size is preferably in the range of 50 to 1000 microns.

The carrier particles may be made of iron or steel optionally provided with an oxide surface layer. Other types of carriers are on the basis of magnetic material such as ferrites or magnetite finely dispersed in a resin binder material, so-called composite type carriers, examples of which are given in U.S. Pat. No. 4,600,675 and published European patent application No. 0 289 663. Iron or steel carrier beads may be subjected to special pretreatments to enhance the triboelectric charging of the toner. Suitable coating-treatments of carrier beads are described e.g. in said last mentioned GB-P 1,438,110.

In magnetic brush development the carrier particles are magnetically attractable. Particularly suited are the iron bead carrier particles according to U.S. Pat. No. 2,786,440, which particles have been washed free from grease and other impurities and have a diameter of $1.52\times10^{-1}$ to $2.03\times10^{-1}$ mm.

In a preferred embodiment of the present invention the toner particles are mixed with iron carrier beads of a diameter in the range of 50 to 200 microns having a thin iron oxide surface layer. These carrier beads have almost a spherical shape and are prepared e.g. by a process as described in GB-P 1,174,571.

The developer composition may for example contain 1 to 5 parts by weight of toner particles per 100 parts by weight of carrier particles.

According to a particular embodiment the flowing properties of the developer are improved by mixing the toner particles with a flow improving substance such as colloidal silica particles and/or microbeads of a fluorinated polymer. The flow improving substance is used e.g. in an amount of 0.05 to 1% by weight with respect to the toner.

Colloidal silica has been described for that purpose in the GB-P 1,438,110. Particularly useful is AEROSIL 300 [trade mark of Degussa, Frankfurt (M) W. Germany] for colloidal silica having a specific surface area of 300 sq.m/g. The specific surface area can be measured by a method described by Nelsen and Eggertsen in "Determination of Surface Area Adsorption Measurements by Continuous Flow Method", Analytical Chemistry, Vol. 30, No. 8 (1958) 1387-1390.

Suitable fluorinated polymer beads for improving the flowing properties of the toner as well as of the carrier particles are described in the U.S. Pat. No. 4,187,329. A preferred fluorinated polymer for said use is poly(tetrafluoroethylene) having a particle size of 3 to 4 μm and melting point of 325°-329° C. Such poly(tetrafluoroethylene) is sold under the trade name HOSTAFLON TF-VP-9202 by Farbwerke Hoechst A. G. W. Germany.

An other fluorinated polymer useful for that purpose is polyvinylidene fluoride having an average particle size of 5 μm sold under the trade name KYNAR RESIN 301 by Pennwalt Corp.-Plastic div. England.

The colloidal silica and/or said fluorinated polymer particles are mixed preferably with the toner in a proportion of 0.15% to 0.075% by weight. The toner is thereby rendered non-tacky and obtains a reduced tendency to form a film on the xerographic plates or drums e.g. having a vapour-deposited coating of a photoconductive Se-As alloy on a conductive substrate e.g. aluminium.

The following comparative example illustrates the present invention without, however, limiting it thereto. All parts, ratios and percentages are by weight unless otherwise stated.

COMPARATIVE EXAMPLE

Toner Preparation Without Colouring Agent

A pseudo toner was prepared without colouring agent to check whether or not the incorporated charge controlling agent yielded a clear mixture on melting with the elected resin binder.

Two comparable colourless pseudo toners were prepared by mixing in the melt 5 parts of a subsequently identified charge controlling substance with 95 parts of copolymer of (styrene-n-butylmethacrylate)(65/35) having a ring and ball softening point: 123° C. which copolymer serves as thermplastic binder. The mixture was melt-kneaded at 130° C. for 30 minutes. Thereupon the mixture was cooled down to room temperature, crushed and then pulverised by milling in a jet mill.

By wind sifter a toner particle fraction having an average particle size of 13 μm was separated.

Developer Preparation

An electroscopic developer was prepared by mixing 3% of the separated toner particles with iron bead carrier particles having an iron oxide surface layer and average grain size of 80 μm. The triboelectric charging of the resulting powder mixture was realized by a 30 minutes agitation in a metal cylinder having a diameter of 6 cm, being filled for approximately 30% by volume with said mixture and revolving at a speed of 60 rpm.

Measurement

Different triboelectric charge measurement techniques are available all being based on the separation of the toner particles from the admixed carrier particles and the determination of the charge of the separated toner particles directly or indirectly. Depending on the applied technique somewhat differing charge to mass ratio (Q/M) values are obtained expressed in coulomb/gram (C/g). For obtaining comparable results the same separation and measuring technique should be used with toner of the same average particle size since the triboelectric charging is a surface phenomenon.

In the present example the separation of the toner from the carrier particles was realized in a commercially available blow-off type powder charge measuring device. By calculating the surface area of the pseudo toner for a given mass and using the Q/M data from the resulting blow-off separation the charge density was calculated, and expressed in $C/cm^2$.

The results obtained with a charge controlling substance according to the structural formula (Z) applied in the present invention and charge controlling compound No. 14 of the already mentioned published unexamined Japanese patent application (Kokai) 6 0188-959 having the following structure are mentioned in Table 2.

TABLE 2

No. 14

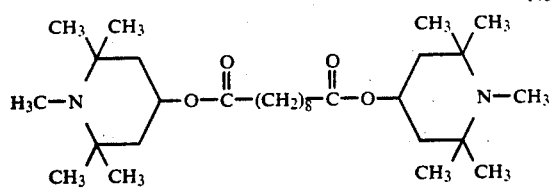

| Charge controlling agent | $10^{-10}$ C/cm$^2$ |
|---|---|
| Compound (Z) | +27.4 |
| Compound (Z).2 HCl | +22.5 |
| No. 14 | +8.1 |

The pseudo toners obtained with said both charge controlling agents were perfectly optically clear which proves their good compatibility with the applied resin binder.

We claim:

1. Particulate toner material for use in the development of latent electrostatic images, wherein said particulate toner material is capable of acquiring by triboelectric contact electrification when in admixture with carrier particles a net positive charge and contains at least one thermoplastic resin as binder in combination with a colorant and a colourless compound capable of imparting a positive charge to the particulate toner material when in frictional contact with said carrier particles, wherein said colourless compound contains in its molecular structure at least one polyalkyl substituted piperidine group and a sterically hindered phenol group.

2. Particulate toner material according to claim 1, wherein said colourless compound corresponds to the following general formula (A):

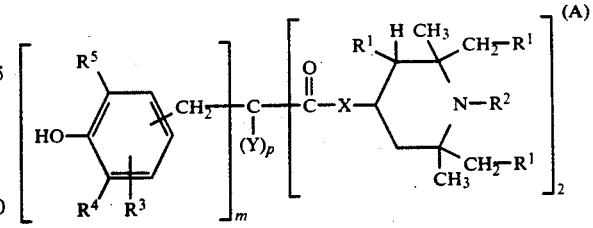

(A)

wherein:

$R^1$ is hydrogen or alkyl having 1 to 4 carbon atoms, $R^2$ is alkyl or hydroxyalkyl, each having 1 to 12 carbon atoms, alkenyl or alkynyl each having 3 or 4 carbon atoms or aralkyl, $R^3$ is hydrogen or methyl, $R^4$ and $R^5$ are each alkyl having 1 to 5 carbon atoms or cycloalkyl having 5 to 8 carbon atoms, X is oxygen or NH, Y is hydrogen, alkyl having 1 to 12 carbon atoms or $-C_nH_nCOOR^7$, in which n is 0 or an integer from 1 to 10 and $R^7$ is hydrogen, alkyl having 1 to 18 carbon atoms or the Y is a substituent of the formula:

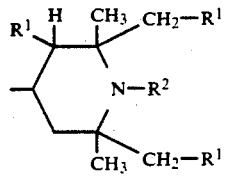

wherein:

$R^1$ and $R^2$ are as defined above, or

Y is a substituent of the formula:

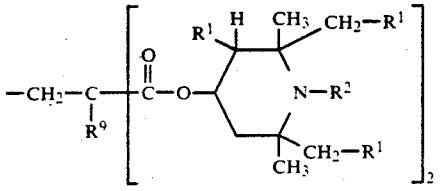

wherein:

$R^1$ and $R^2$ are as defined above, and $R^9$ is hydrogen or alkyl having 1 to 4 carbon atoms, m is 1 or 2, and p is 0 or 1.

3. Particulate toner material according to claim 1, wherein said colourless compound is used in amount in the range of 0.5 to 5% by weight with respect to the total toner composition.

4. Particulate toner material according to claim 1, wherein said colourless compound is dissolved or dispersed in a thermoplastic binder resin selected from the group consisting of a homo- and copolymer of styrene wherein the styrene content is at least 50 mole %.

5. Particulate toner material according to claim 4, wherein said copolymer is selected from the group consisting of styrene-methyl acrylate copolymer, styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer, styrene-heptadecyl methacrylate copolymer, copoly(styrene-butadiene), and a copolymer of styrene including up to 25% by weight of monomer units comprising a dialkylamino group.

6. Particulate toner material according to claim 1, wherein the colorant is carbon black.

7. Particulate toner material according to claim 1, wherein the colorant is an organic dye or pigment selected from the group consisting of phthalocyanine dyes, quinacridone dyes, triaryl methane dyes, sulphur dyes, acridine dyes, azo dyes and fluoresceine dyes.

8. Particulate toner material according to claim 1, wherein the toner particles incorporate a magnetic or magnetizable material.

9. An electroscope developer comprising particulate toner material according to claim 1, in admixture with carrier particles suited for use in cascade-, or magnetic brush development of latent electrostatic charge images.

10. Particulate toner material according to claim 9, wherein said carrier particles are at least 3 times larger in size the toner particles and have an average grain size in the range of 50 to 1000 microns.

11. Particulate toner material according to claim 9, wherein the carrier particles are made of iron or steel provided with an oxide surface layer.

* * * * *